US005617996A

United States Patent [19]

Julve

[11] Patent Number: 5,617,996

[45] Date of Patent: Apr. 8, 1997

[54] TRACK FOR ELECTRIC CARS

[75] Inventor: Eduardo N. Julve, Esplugues de Llobregat, Spain

[73] Assignee: Ninco Desarrollos, S.L., Esplugues de Llobregat, Spain

[21] Appl. No.: 600,372

[22] Filed: Feb. 13, 1996

[30] Foreign Application Priority Data

Aug. 1, 1995 [ES] Spain ..... 9502125
Sep. 29, 1995 [ES] Spain ..... 9502508

[51] Int. Cl.[6] ..... E01B 23/00

[52] U.S. Cl. ..... 238/10 R; 238/10 E; 238/10 F

[58] Field of Search ..... 238/10 R, 10 A, 238/10 E, 10 F, 14.05, 14.4; 104/DIG. 1; 446/444

[56] References Cited

U.S. PATENT DOCUMENTS 3,228,607 1/1966 Robinette et al. ..... 238/10 F
3,288,368 11/1966 Athearn ..... 238/10 F
3,830,426 8/1974 Martin ..... 238/10 F
4,179,066 12/1979 Teter ..... 238/10 F
4,997,187 3/1991 Smollar et al. .
5,405,080 4/1995 Yeung et al. ..... 238/10 F

FOREIGN PATENT DOCUMENTS 1256125 12/1967 Germany ..... 238/10 F

*Primary Examiner*—S. Joseph Morano
*Attorney, Agent, or Firm*—Young & Thompson

[57] ABSTRACT

A track for electric cars with a novel mechanism to connect successive track segments. On one side of each connecting edge and centered on the corresponding guideway is a male attachment element formed by two rectangular projections ending in a small ramp, located on either side of the guideway. There is a rectangular recess with a centering rib on each sidewall between the ramp and the connecting edge. The opposite connecting edge of each track segment contains a female attachment mechanism designed to accept the male attachment mechanism.

5 Claims, 3 Drawing Sheets

TRACK FOR ELECTRIC CARS

BACKGROUND OF THE INVENTION

This invention pertains generally to the field of tracks for electric cars.

As is known, tracks for small-scale electric cars are built from a plurality of modular track section which are assembled with joining means and centered end-to-end.

Generally, these tracks consist of straight or curved sections made of plastic with a rough surface, with two double metal notched rails to conduct electricity.

The tracks currently in use must be interconnected by raising them above the surface on which they rest in order to manipulate the various holding and adjusting components incorporated therein. This manipulation is very difficult, since the accumulated length of already-assembled track limits movement.

Additionally, handling the tracks under these conditions overstresses the support points which are designed specifically to absorb forces in a direction parallel to the plane of the section; as a consequence, the joining elements are rapidly weakened.

SUMMARY OF THE INVENTION

The track for electric cars according to the invention is an improvement over conventional tracks because it incorporates a type of joint which is designed in such a way as to allow track section to be connected by pressing them together without having to lift them, ensuring a stable junction which cannot be pulled apart, with disassembly only being possible by lifting the sections and manually separating the anchors.

In essence, the track according to the invention is made up of track sections, each of which comprises a plate of plastic with a rough surface, with four electrically conducting metal rails inserted so as to form two parallel guideways on which the electric cars run, said plate having at each end male-type joining means which are designed as follows:

On one side of each connection edge and centered on the corresponding guideway is a male attachment element formed by two rectangular projections ending in a small ramp, located on either side of the guideway. A rectangular recess with two centering ribs on its side walls lies between the ramp and the connecting edge from which it extends.

On the opposite side, and centered on the other guideway of the track, is a female attachment means composed of two slots with a cross-section which fits that of the male attachment elements, also located on either side of the guideway, behind which at a suitable distance is a rectangular lug emerging from the lower face of the plastic plate, with a surface inclined downwards in the direction of the end of the track.

Crossing the slots of the female attachment elements there are two tongues which fit grooves made on each side of the base of the rectangular projections in the male attachment elements.

The tongues serve to center the joined tracks and to ensure that the sections are at the same height.

This configuration is repeated at the opposite end of the track but with the sides reversed.

The metal rails are inserted into channels made in the surface of the plastic plate, said channels having at each end a pin for centering and holding a connection clip between rails which conduct electricity, as well as a series of projections for guiding the rail during the insertion phase, and rectangular slots for securing them correspondingly.

The coupling clip for the electrical junction between rails is formed of a self-supporting molded piece with a basically rectangular shape, which is directly driven onto the pin without need for folding.

Optionally, the clip can also be made by stamping, in which case it would be formed by three lips rounded off with their corresponding folded ends inserted into a small groove made for this purpose in the end of the pins, and a horizontal overhang which allows the pieces to be attached in the stamping stage.

To assemble two track sections, they are placed flat aligning the pins of the guideways with the electric rails and the tongues with the grooves. Then the male attachment elements are inserted in the slots of the female attachment element until the rectangular projection of the male attachment elements abut the rectangular lug, with application of slight pressure until the end of the male rectangular projection slips onto the lug, the lug then fitting in the rectangular recess located in the aforementioned male projection, connecting the track sections.

To disassemble the tracks, very slightly bend the male rectangular projection until the female rectangular lug is released, disconnecting the adjacent track sections.

BRIEF DESCRIPTION OF THE DRAWINGS

To illustrate the above, three pages of drawings accompany and are incorporated into this description which show in a simplified and schematic manner two practical embodiments of the invention, given by way of illustration and without limitation.

In these drawings.

DESCRIPTION OF THE PREFERRED EMBODIMENTS

Figure 1:
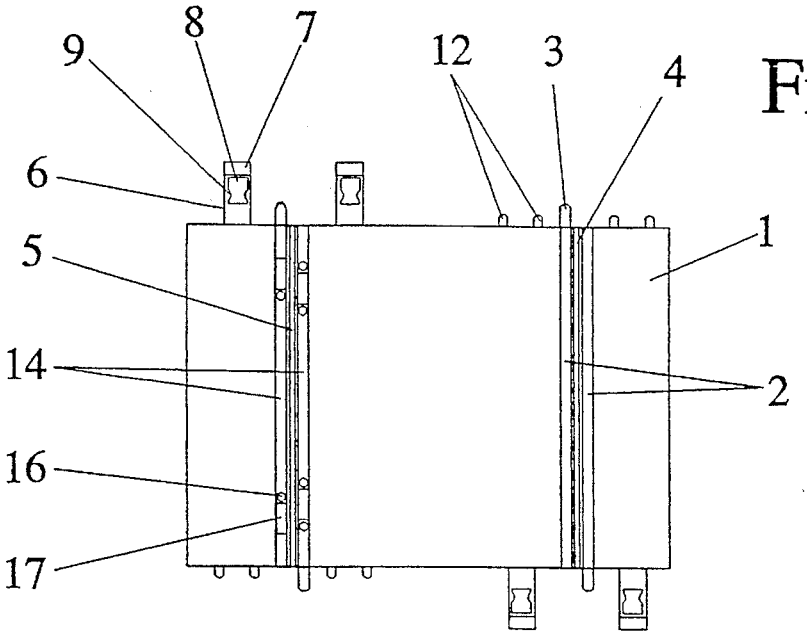
FIG. 1 shows an overhead view of a track section.
Figure 2:
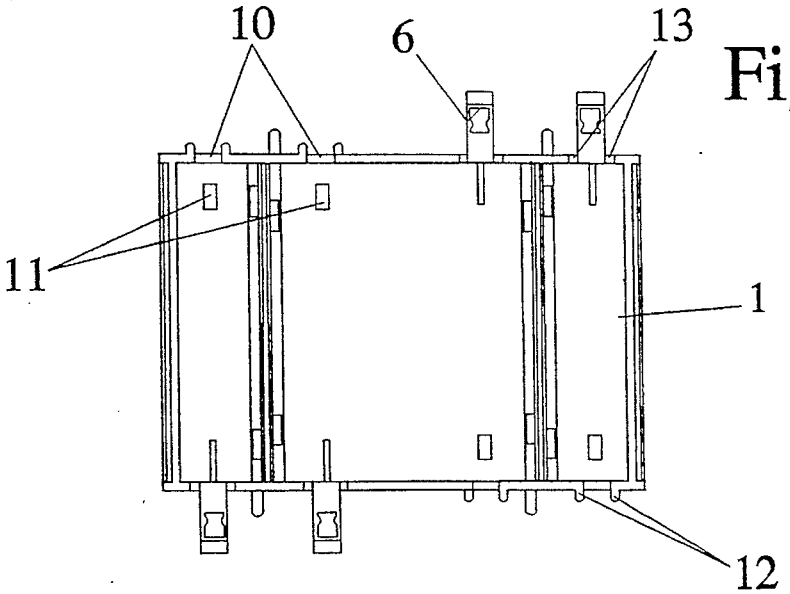
FIG. 2 shows a bottom view of a track section.
Figure 3:
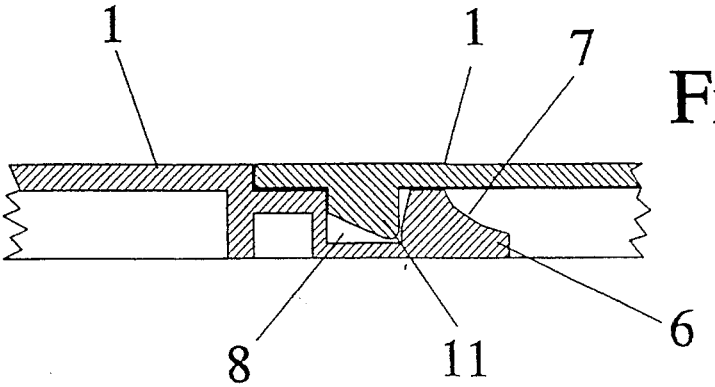
FIG. 3 shows a sectional view according to the invention revealing the manner in which the attachment elements are joined.

As shown in FIGS. 1–3, the device according to the invention is a track for electric cars comprising a plastic plate with rough surface 1 with four rails which conduct electricity 2 inserted so as to form two parallel guideways 4 and 5 having at either end joining means designed as follows:

At the lower end on the right-hand side and at the upper end on the left-hand side and centered on the corresponding guideway, there is a male attachment element formed by two rectangular projections 6 ending in small ramp 7 placed on either side of the guideway, in front of which for each there is rectangular recess 8 with two centering ribs 9 on its side walls.

At the lower end on the left-hand side and at the upper end on the right-hand side and also centered on the corresponding guideway there is a female attachment element comprising two slots 10 also on either side of the guideway, behind which at a suitable distance is rectangular lug 11 emerging from the lower face of the plastic plate.

On either side of the slots of the female attachment elements are two tongues 12 which fit two grooves 13 made on each side of the base of the rectangular projections 6 in the male attachment elements.

Metal rails 2 are inserted into channels 14 made in the surface of plastic plate 1, said channels having at each end pin 15 as well as three lugs 16 for guiding the rails during insertion and two slots 17 for securing them correspondingly.

As shown in FIGS. 4–7, coupling clip 3 may be joined to the pins, said clip having been manufactured by molding 19 or stamping 22.

Figure 4:
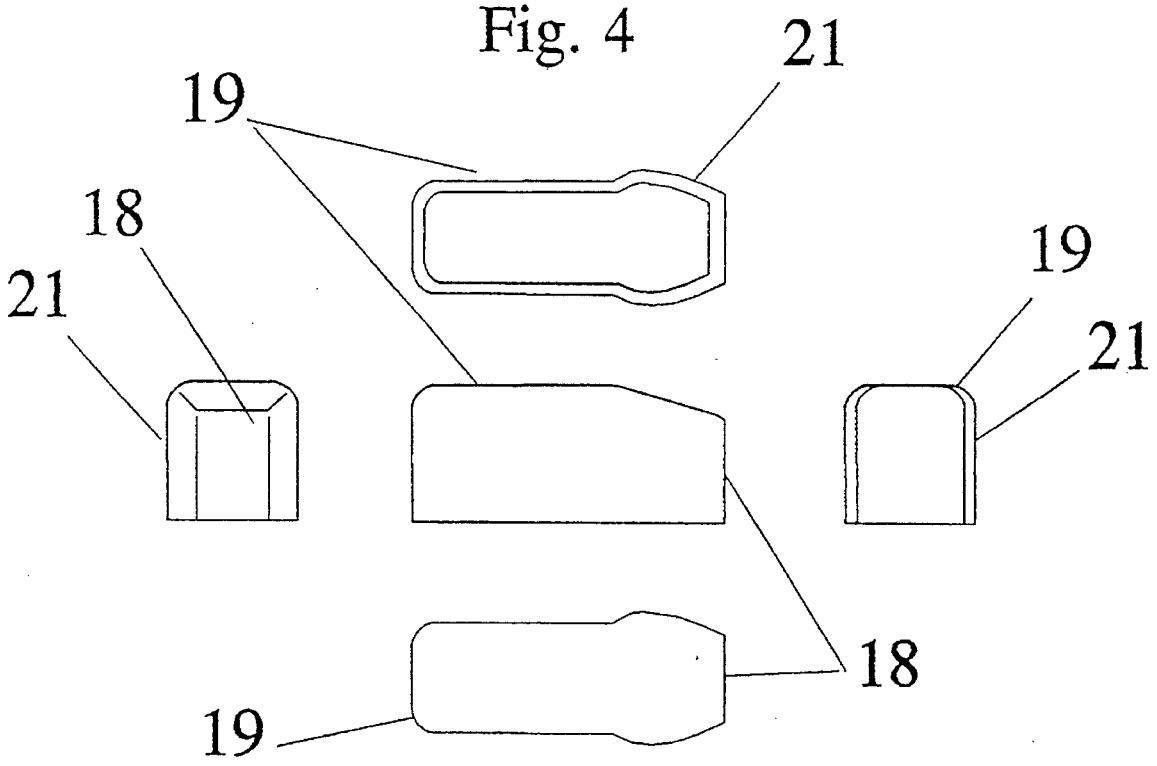
FIG. 4 shows an elevated, level, and profile view of the coupling clip manufactured by molding.
Figure 5:
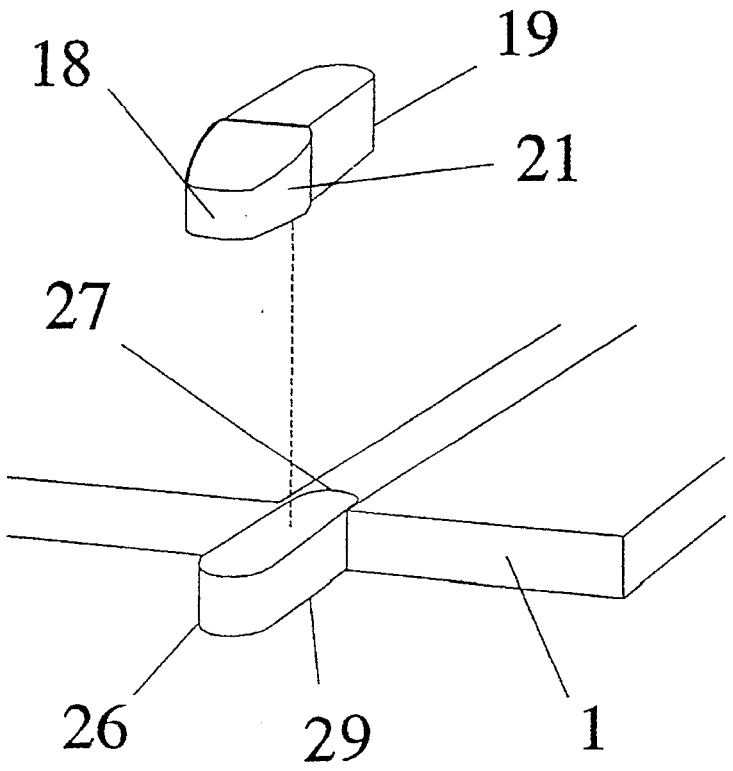
FIG. 5 shows a perspective view of the clip and the pin manufactured by molding, revealing its manner of placement.

As shown in FIGS. 4 and 5, in the molded clip 19 is a self-supporting molded foundation piece with uniform thickness 19, with a basically rectangular shape, and which has widened area 21 in front. This wider part has on its upper face an inclination which runs downward to its front part 18. This clip slips over plastic pin 29, connected to the track for electric cars 1, said pin having its front end 26 and back end 27 considerably rounded.

Figure 6:
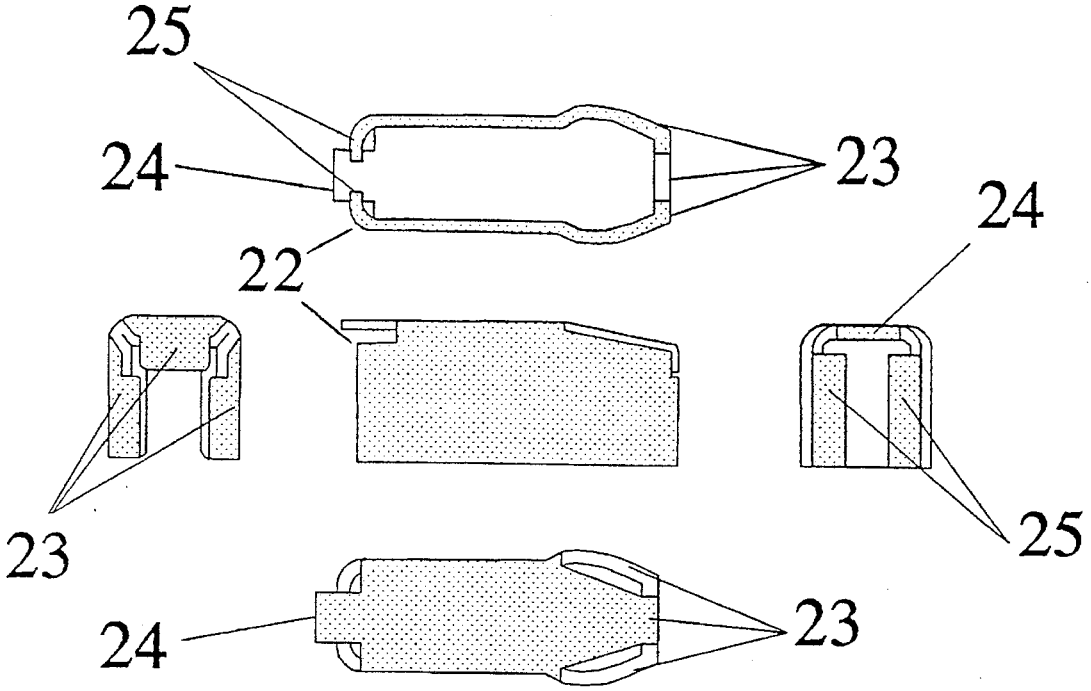
FIG. 6 shows an elevated, level and profile view of the coupling clip manufactured by stamping.
Figure 7:
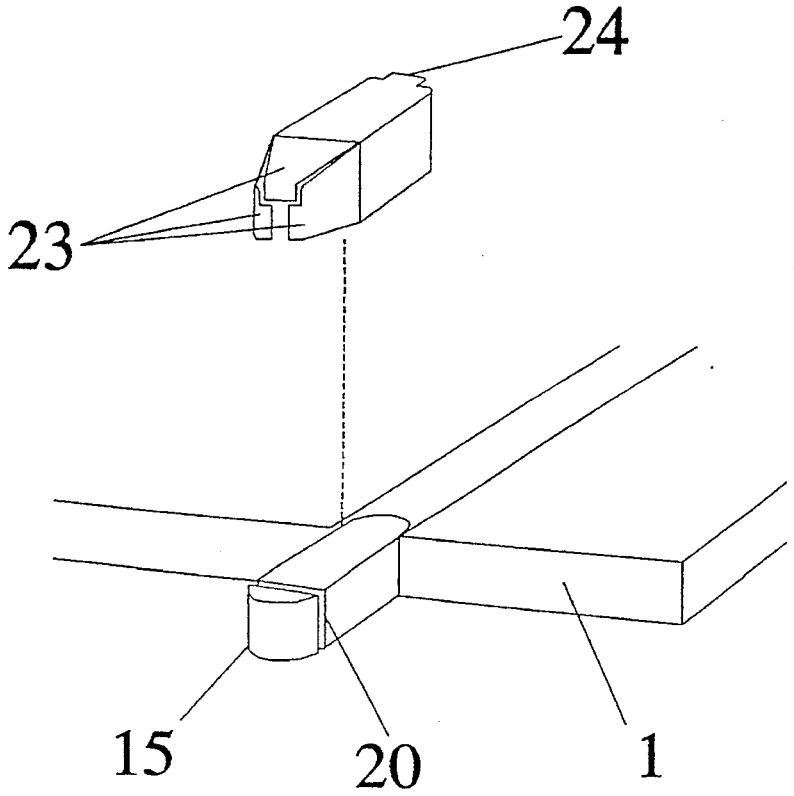
FIG. 7 shows a perspective view of the clip and pin manufactured by stamping, revealing its manner of placement.

Optionally, the clip may be made by stamping, as in FIGS. 6 and 7 in which case it would have three rounded tabs 23 with their corresponding ends folded and inserted into small groove 20 made for this purpose in the end of pin 15.

The posterior end of the clip has two tabs 25 folded at right angles, and horizontal overhang 24.

While the invention has been described with relation to various preferred embodiments, various modifications and adaptations thereof will be readily apparent to those skilled in the art. All such modifications and adaptations that fall within the scope of the appended claims are intended to be covered thereby.

I claim:

1. A track for electric cars comprising a plurality of track segments, each of said track segments comprising a straight or curved plastic plate with a rough surface, each of said track segments further comprising electrically conducting rails inserted therein, said rails forming a plurality of guideways on which said electric cars run, each of said track segments having a first and second end, each said end having a right-hand and left-hand side, each said end further having means of interconnecting said track segments, wherein said plastic plate has disposed upon said right-hand side of said first end and said left hand side of said second end and centered upon the corresponding guideway, rectangular projections ending in a small ramp, said rectangular projections each having disposed therein a rectangular recess between said small ramp and the end upon which said rectangular projection is disposed, said rectangular recess having two centering ribs on side walls thereof, said plastic plate further having disposed upon said left-hand side of said first end and said right-hand side of said second end and also centered on said corresponding guideway, slots behind which is disposed a rectangular lug emerging from a lower face of said plastic plate with a surface inclining downward toward said slots.

2. Track for electric cars according to claim 1 wherein tongues are disposed on said ends adjacent to said slots, said tongues fitting grooves disposed on said ends on each side of said rectangular projections.

3. Track for electric cars according to claim 1, wherein said guideways have at each end a pin and a plurality of lugs, said lugs guiding said rails during insertion, and a plurality of additional slots to secure said rails.

4. Track for electric cars according to claim 3, wherein molded coupling clips are joined to said pins, said clips having a substantially rectangular shape, said clips having a front end with a widened area, said front end having an inclined top, said clip being placed by simply driving in said pin.

5. Track for electric cars according to claim 3, wherein stamped coupling clips are joined to said pins, said clips having an end exterior to said plastic plate comprising three rounded tabs, said tabs having their ends folded and inserted into a small groove in the end of a respective said pin said clips further having an end interior to said plastic plate comprising two straight vertical tabs bent into a right angle, and a horizontal overhang.

* * * * *

UNITED STATES PATENT AND TRADEMARK OFFICE

CERTIFICATE OF CORRECTION

PATENT NO. : 5,617,996

DATED : April 8, 1997

INVENTOR(S) : Eduardo Nin Julve

It is certified that error appears in the above-indentified patent and that said Letters Patent is hereby corrected as shown below:

On the title page, under item [19], change "Julve" to --Nin Julve--.

On the title page, item [75], change "Eduardo N. Julve" to --Eduardo Nin Julve--.

Signed and Sealed this

Tenth Day of June, 1997

*Attest:*

*Attesting Officer*

BRUCE LEHMAN

*Commissioner of Patents and Trademarks*